US009377011B2

(12) United States Patent
Shreve et al.

(10) Patent No.: US 9,377,011 B2
(45) Date of Patent: Jun. 28, 2016

(54) HIGH PRESSURE PUMP WITH REDUCED SEAL WEAR

(75) Inventors: Joshua A. Shreve, Franklin, MA (US); Neal B. Almeida, Cumberland, RI (US); John Angelosanto, North Attleboro, MA (US); Joseph A. Luongo, Walpole, MA (US)

(73) Assignee: WATERS TECHNOLOGIES CORPORATION, Milford, MA (US)

( * ) Notice: Subject to any disclaimer, the term of this patent is extended or adjusted under 35 U.S.C. 154(b) by 337 days.

(21) Appl. No.: 14/007,392

(22) PCT Filed: Apr. 17, 2012

(86) PCT No.: PCT/US2012/033868

§ 371 (c)(1),
(2), (4) Date: Sep. 25, 2013

(87) PCT Pub. No.: WO2012/148726

PCT Pub. Date: Nov. 1, 2012

(65) Prior Publication Data

US 2014/0044577 A1 Feb. 13, 2014

Related U.S. Application Data

(60) Provisional application No. 61/478,750, filed on Apr. 25, 2011.

(51) Int. Cl.
*F04B 7/00* (2006.01)
*F04B 15/00* (2006.01)
(Continued)

(52) U.S. Cl.
CPC ..... *F04B 7/0088* (2013.01); *F04B 15/00* (2013.01); *F04B 53/007* (2013.01); *F04B 53/02* (2013.01); *F04B 53/164* (2013.01)

(58) Field of Classification Search
CPC .... F04B 15/00; F04B 15/0088; F04B 53/007; F04B 53/164; F04B 53/02
See application file for complete search history.

(56) References Cited

U.S. PATENT DOCUMENTS

| | | | |
|---|---|---|---|
| 7,665,480 | B2 | 2/2010 | Angelosanto et al. |
| 2008/0020136 | A1 | 1/2008 | Ciolkosz et al. |

(Continued)

FOREIGN PATENT DOCUMENTS

| | | | |
|---|---|---|---|
| JP | 0462370 | U | 5/1992 |
| JP | 2006189025 | A | 7/2006 |
| JP | 2009533628 | A | 9/2009 |

OTHER PUBLICATIONS

International Search Report and Written Opinion in international patent application No. PCT/US12/33868, mailed on Jul. 13, 2012; 8 pages.

(Continued)

*Primary Examiner* — Thomas E Lazo
*Assistant Examiner* — Logan Kraft
(74) *Attorney, Agent, or Firm* — Schmeiser, Olsen & Watts LLP

(57) ABSTRACT

Described are embodiments of a pump that can be used, for example, in liquid chromatography applications. The pump includes a seal wash housing, pump head and seal assembly. A wear-resistant coating applied to a sealing surface or gland of the pump head or seal wash housing improves the hardness and chemical compatibility of the sealing surface. Oxidation of the sealing surface is reduced so that the sealing surface is less abrasive to the seal assembly and the lifetime of the seal assembly is increased.

8 Claims, 5 Drawing Sheets

(51) Int. Cl.

| | |
|---|---|
| ***F04B 53/00*** | (2006.01) |
| ***F04B 53/02*** | (2006.01) |
| ***F04B 53/16*** | (2006.01) |

(56) References Cited

U.S. PATENT DOCUMENTS

| | | | |
|---|---|---|---|
| 2008/0260558 | A1 | 10/2008 | Luongo et al. |
| 2010/0012192 | A1 | 1/2010 | Dourdeville et al. |
| 2010/0089134 | A1 | 4/2010 | Haertl |

OTHER PUBLICATIONS

International Preliminary Report on Patentability in counterpart international patent application No. PCT/US12/33868, mailed on Nov. 7, 2013; 7 pages.

Extended Search Report in related European Patent Application No. 12777825.6, mailed on Jun. 23, 2015; 7 pages.

Official Action in related Japanese patent application No. 2014-508416, mailed on Mar. 1, 2016; 6 pages.

HIGH PRESSURE PUMP WITH REDUCED SEAL WEAR

RELATED APPLICATION

This application claims the benefit of the earlier filing date of U.S. Provisional Patent Application Ser. No. 61/478,750, filed Apr. 25, 2011 and titled "High Pressure Pump with Reduced Seal Wear," the entirety of which is incorporated herein by reference.

FIELD OF THE INVENTION

The invention relates generally to high pressure pumps. More particularly, the invention relates to a high-pressure pump having reduced seal wear due to seal movement during pressure cycling.

BACKGROUND

Worn out high-pressure seals are a common leak point in reciprocating pump applications, such as liquid chromatography, in which a pump moves fluid under pressure. For instance, in liquid chromatography systems, typically one or more high-pressure pumps take in solvents and deliver a liquid solvent composition to a sample manager, where a sample awaits injection into a mixture. High-performance liquid chromatography (HPLC) systems use high pressure, ranging traditionally between 1,000 to 6,000 psi, to generate the flow required for liquid chromatography in packed columns. In contrast to HPLC, ultra HPLC (UPLC®) systems use columns with smaller particulate matter and high pressures that can reach or exceed 20,000 psi to deliver a mobile phase. In many liquid chromatography systems, two or more actuators are employed in a serial or parallel configuration.

In various liquid chromatography applications, a high-pressure seal resides within a gland in the pump fluidic area. The outside diameter (OD) of the high-pressure seal provides a seal against an external sealing surface while the inside diameter (ID) of the high-pressure seal provides a seal against a reciprocating plunger.

SUMMARY

In one aspect, the invention features a pump that includes a seal wash housing, pump head, seal assembly and wear-resistant coating. The seal wash housing has a pair of opposing surfaces, a gland and a bore that extends between the surfaces and through the gland. The pump head has a sealing surface abutting one of the surfaces of the seal wash housing and a chamber that extends from a first opening in the sealing surface. The seal assembly is present in the gland of the seal wash housing and has a sealing surface abutting the sealing surface of the pump head. The wear-resistant coating is on the sealing surface of the pump head at least in a surface region where the sealing surface of the seal assembly abuts the sealing surface of the pump head. In some instances, the wear-resistant coating is a diamond like carbon (DLC) coating or titanium coating.

In another aspect, the invention features a pump that includes a pump head, seal wash housing, seal assembly and wear-resistant coating. The pump head has a gland and a chamber extending from the gland. The seal wash housing includes a sealing surface. The seal assembly is present in the gland of the pump head and has a sealing surface in abutment with the sealing surface of the seal wash housing. The wear-resistant coating is on the sealing surface of the seal wash housing, at least in a surface region where the sealing surface of the seal assembly abuts the sealing surface of the seal wash housing. In some instances, the wear-resistant coating is a DLC coating or titanium coating.

BRIEF DESCRIPTION OF THE DRAWINGS

The above and further advantages of this invention may be better understood by referring to the following description in conjunction with the accompanying drawings, in which like reference numerals indicate like elements and features in the various figures. For clarity, not every element may be labeled in every figure. The drawings are not necessarily to scale, emphasis instead being placed upon illustrating the principles of the invention.

DETAILED DESCRIPTION

Reference in the specification to "one embodiment" or "an embodiment" means that a particular, feature, structure or characteristic described in connection with the embodiment is included in at least one embodiment of the teaching. References to a particular embodiment within the specification do not necessarily all refer to the same embodiment.

The present teaching will now be described in more detail with reference to exemplary embodiments thereof as shown in the accompanying drawings. While the present teaching is described in conjunction with various embodiments and examples, it is not intended that the present teaching be limited to such embodiments. On the contrary, the present teaching encompasses various alternatives, modifications and equivalents, as will be appreciated by those of skill in the art. Those of ordinary skill having access to the teaching herein will recognize additional implementations, modifications and embodiments, as well as other fields of use, which are within the scope of the present disclosure as described herein.

Actuators described herein can be employed in high-pressure and low-pressure reciprocating and rotary applications, such as are commonly used in liquid chromatography. The actuator assembly has a pump head with a chamber, a seal wash housing, a gland in either the pump head or seal washing housing, and a high-pressure seal assembly located within the gland. The pump head has an inlet port and an outlet port, each port being in fluidic communication with the chamber. Movement of a plunger within the chamber draws fluid into the chamber through the inlet port and pumps the fluid out of the chamber through the outlet port.

Figure 1:
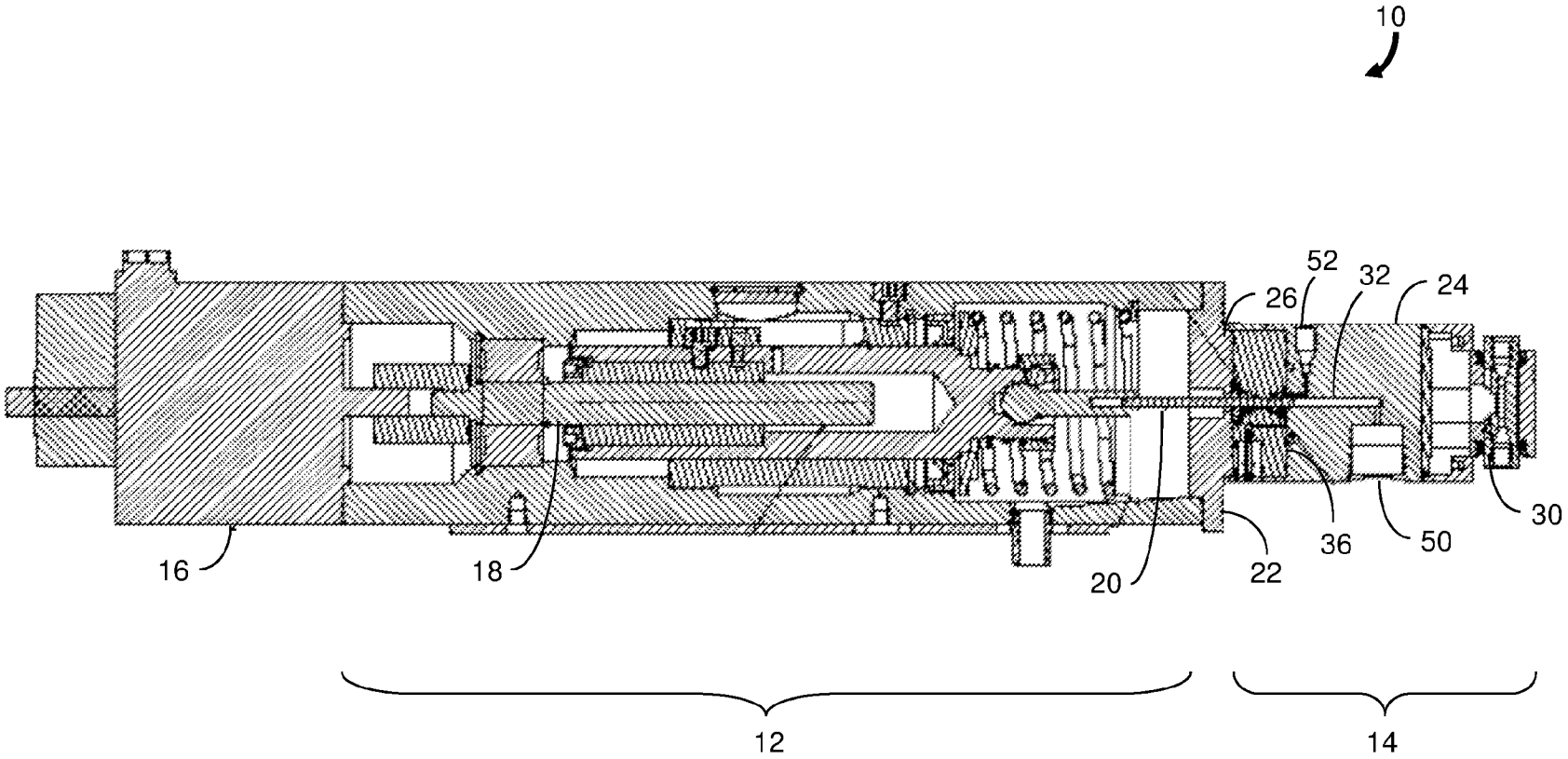
FIG. 1 is a cross-section diagrammatic view of an embodiment of an actuator assembly used in liquid chromatography applications, the actuator assembly comprising a motor with an attached encoder, an actuator body, a pump head and a seal wash housing.
Figure 2:
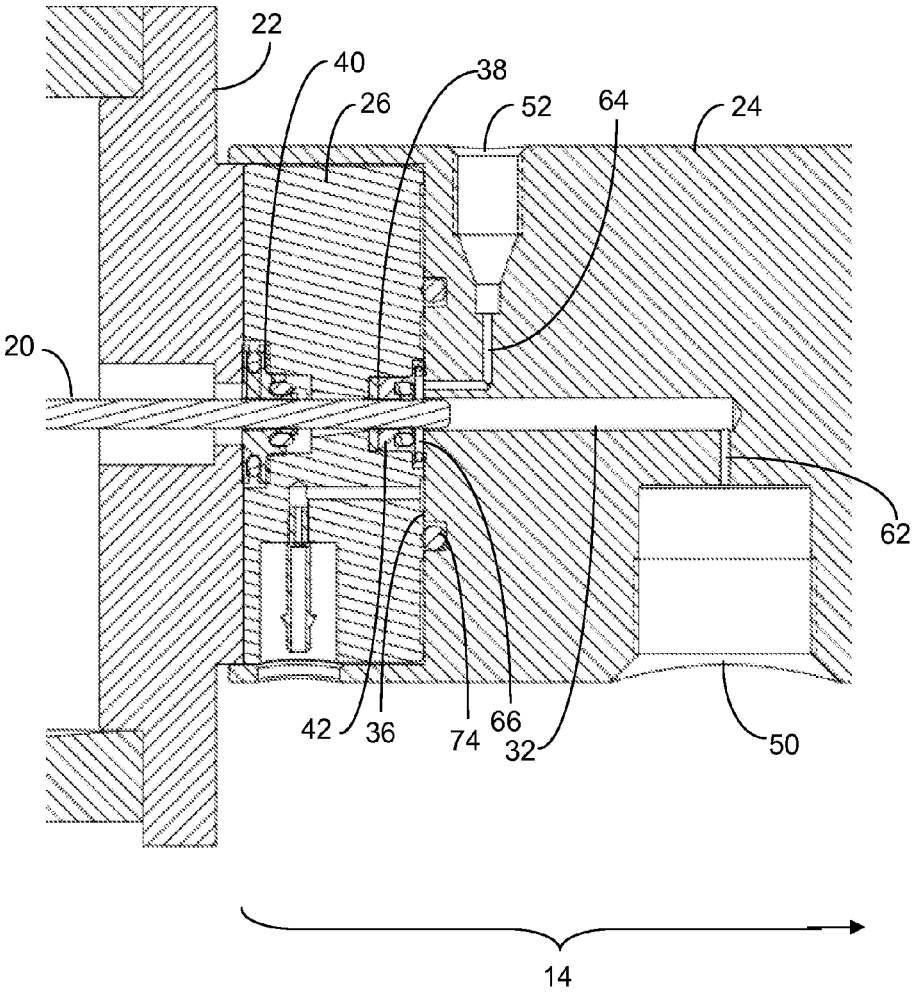
FIG. 2 is an enlarged cross-sectional view of a fluidic portion of the actuator assembly of FIG. 1 that includes the pump head, seal wash housing, a plunger and low-pressure and high-pressure seal assemblies.

FIG. 1 shows an embodiment of an actuator assembly 10 having a main actuator body 12 connected to a fluidic assembly 14 and FIG. 2 shows an enlarged view of a portion of the fluidic assembly 14. The main actuator body 12 includes a drive mechanism 18 mechanically linked to a plunger 20.

Although described in connection with reciprocating plungers, the fluidic outlet mechanisms described herein can also be used in actuator assemblies with rotary shafts, such as a shaft that rotates and turns a rotor fitted to a stator. The term "rod" is used herein to broadly encompass plungers, shafts, rods, and pistons, whether reciprocating or rotary. The support plate 22 is secured to the actuator body 12.

The fluidic assembly 14 includes a pump head 24 secured to the support plate 22. A seal wash housing 26 is located in a counterbore of the pump head 24 along one side of the support plate 22. A pressure transducer 30 is secured to the pump head 24 and monitors the internal pressure of the fluid in the pump head 24 throughout the operation of the actuator assembly 10.

The pump head 24 includes a chamber 32, a bore opening 34 (see FIG. 3B), and a seal wash housing abutment surface 36 surrounding the bore opening 34. The plunger 20 extends through the seal wash housing 26 and the bore opening 34 of the pump head 24 into the chamber 32. The seal wash housing 26 provides a compartment to purge fluid and wash the plunger 20 of any particulate that may form on the plunger surface. A high-pressure seal assembly 38 and low-pressure seal assembly 40 serve to contain fluids within their appropriate quarters; the high-pressure seal assembly 38 keeps fluid at a pressure up to or greater than 20,000 psi from leaking into the seal wash housing 26 and other unwanted areas of the pump head 24, and the low-pressure seal assembly 40 keeps the wash fluid in the seal wash compartment. In this embodiment, the high-pressure seal assembly 38 resides within a gland 42 in the seal wash housing 26. The pump head 24 further includes an inlet port 50 and an outlet port 52 through which fluid is received and discharged, respectively. The inlet port 50 joins the chamber 32 at the chamber's remote end, whereas the outlet port 52 is in fluidic communication with the chamber's other end through a seal cavity 66.

In one embodiment, the actuator assembly 10 is one of two independently controllable actuators for one of the pumps in a binary solvent manager (BSM). The two actuators are connected in series. One actuator, referred to as the primary actuator, transfers solvents drawn from its chamber 32 to the other actuator, referred to as the accumulator. The intake of fluid occurs in response to the plunger of the primary actuator moving within the chamber in a rearward direction and the transfer of pressurized fluid to the accumulator occurs in response to the plunger of primary actuator moving in a forward direction. Closure of an inlet check valve (not shown) ensures expulsion of the pressurized fluid from the chamber through outlet port, rather than through the inlet port. The accumulator delivers the solvent composition to downstream components of the liquid chromatography system. An example implementation of a BSM pump is the ACQUITY UPLC Binary Solvent Manager, manufactured by Waters Corp. of Milford, Mass.

Seals are common sources of leaks in pumps operating at high pressure levels. For example, in the illustrated pump, the high-pressure seal assembly 38 is subject to repeated high pressure pulsations in the primary actuator. After long periods of use (e.g., hundreds of thousands to millions of pressure cycles), seal performance may degrade and leakage can occur. In particular, wear may cause fluid to leak at the interface 78 (see FIG. 4) between the sealing surface 36 of the pump head and the abutting OD surface of the seal assembly 38. This problem is more likely to occur when the pump operates with certain solvents (e.g., a combination of water and trifluoroacetic acid (TFA)). The sealing surface 36 of the pump head 24 that receives the OD portion of the seal assembly 38 may be made of stainless steel having a passivation layer. The passivation layer can wear and thereby allow accelerated oxidation to occur, resulting in a rough surface with a pattern that approximately matches the shape of the abutting OD portion of the seal assembly 38. With continued movement of the seal assembly 38 during pressure cycling, the rough surface degrades the OD sealing surface and the operational lifetime of the seal assembly 38 is decreased. As described in more detail below, a wear-resistant coating applied to the sealing surface 36 of the pump head 24 substantially limits surface wear and extends the lifetime of the seal assembly 38.

Figure 3A:
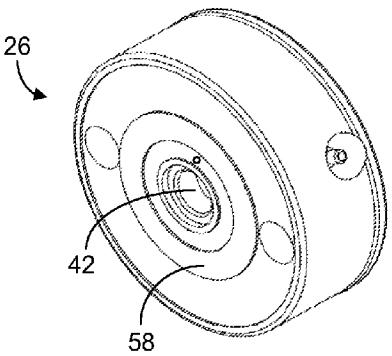
FIGS. 3A and 3B are exploded views of a portion of the actuator assembly shown in FIG. 1 that show the pump head, seal wash housing and high-pressure seal assembly.
Figure 3A:
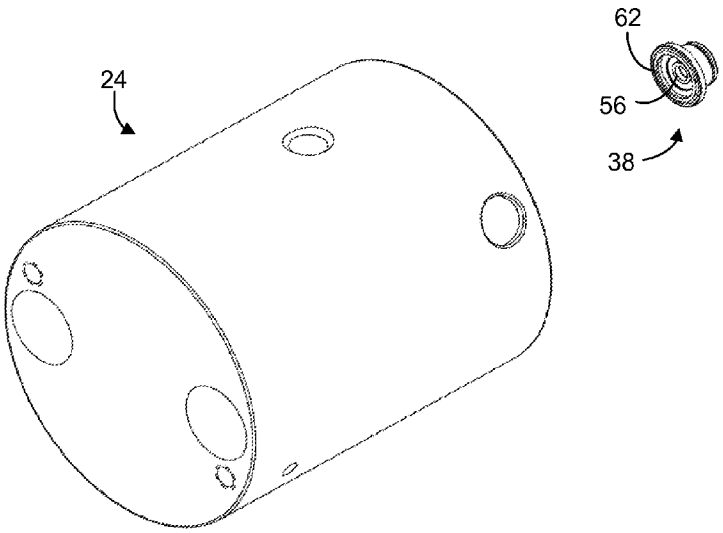
Figure 3B:
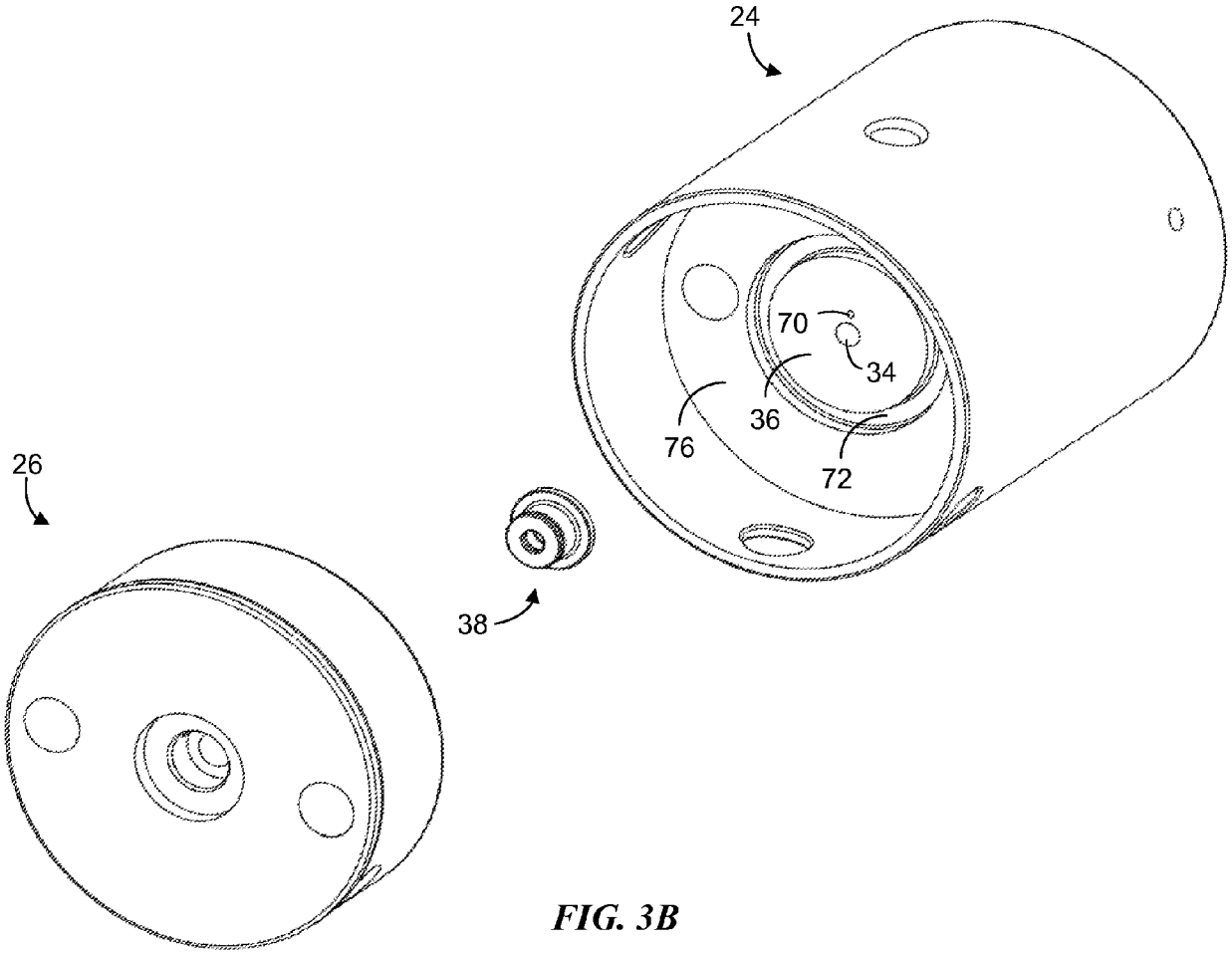

FIGS. 3A and 3B show an exploded view of the pump head 24, seal wash housing 26 and high pressure seal assembly 38 from two viewing perspectives. The sealing surface 36 comprises at least a portion of a surface that opposes the abutment surface 58 of the seal wash housing 26 and includes the bore opening 34 to the chamber 32 and another opening 70 at one end of the channel 64 that conducts fluid to the outlet port 52. An annular grove 72 adapted for receiving an O-ring 74 (see FIG. 2) separates the sealing surface 36 from outer surface 76 that receives the abutment surface 58 of the seal wash housing 26.

Figure 4:
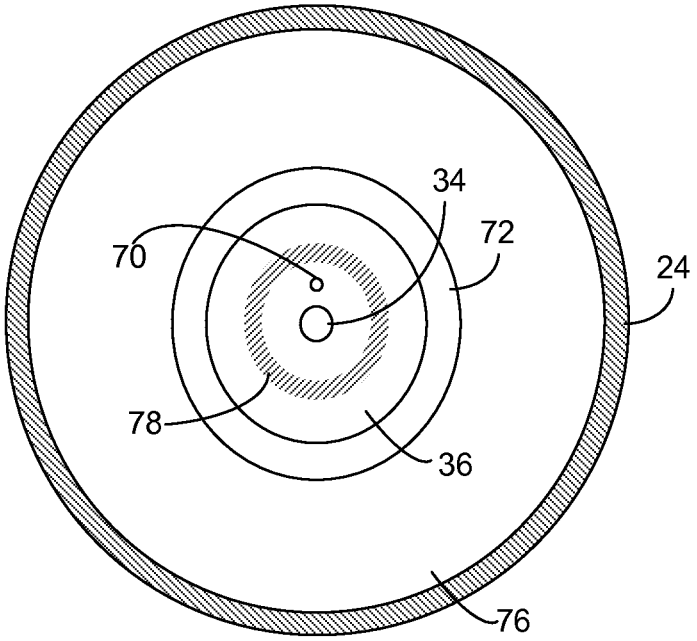
FIG. 4 illustrates the pump head sealing surface of FIG. 3B and indicates the region where the high-pressure seal assembly abuts the sealing surface on the pump head.

During primary actuator operation, the ID portion 56 of the high-pressure seal 38 experiences the plunger movement and the OD surface 62 of the high-pressure seal 38 moves against the sealing surface 36 of the pump head 24. Each pressure cycle places a high load on the seal assembly 38, causing it to compress and deform. Each time the pressure is relieved, the seal assembly 38 shifts back to its original position. This deformation of the seal assembly 38 typically occurs millions of times during its lifetime and, as a result, the OD surface 62 can be slowly damaged. FIG. 4 illustrates, as shaded region 78, where the OD portion 62 of the seal assembly 38 abuts the sealing surface 36 and, consequently, the location of the surface wear.

In the illustrated embodiment, the sealing surface 36 of the pump head 24 is coated with a wear-resistant coating that improves the hardness and chemical compatibility relative to an untreated surface. As a result, various solvents such as TFA do not oxidize the sealing surface 36 and the abrasiveness of the sealing surface 36 against the OD portion 62 of the seal assembly 38 is substantially reduced. Advantageously, the lifetime of the seal assembly 38 is increased. The wear-resistant coating can be any coating that improves the hardness and smoothness of the sealing surface 36. In preferred embodiments, the wear-resistant coating is a diamond like carbon (DLC) coating or titanium coating.

In some embodiments, the wear-resistant coating is applied only to a limited region of the sealing surface 36. For example, only a small region of the surface 36 that includes the abutment region 78 has to be treated to realize the benefit of reduced wear.

Although application of a wear-resistant coating is generally easier to apply to an exposed surface, certain embodiments contemplate a sealing surface within a gland that receives a surface of a seal assembly. For example, in alternative embodiments the high pressure seal assembly 38 is disposed in a gland in the pump head 24. In these instances, at least a portion of the gland is coated with a wear-resistant coating in a manner similar to that for an exposed sealing surface.

While the invention has been shown and described with reference to specific embodiments, it should be understood by those skilled in the art that various changes in form and detail may be made therein without departing from the spirit and scope of the invention as recited in the accompanying claims.

What is claimed is:

1. A pump comprising:

a seal wash housing having a pair of opposing surfaces, a gland and a bore that extends between the surfaces and through the gland;

a pump head having a sealing surface having a first opening and a second opening, the sealing surface abutting one of the surfaces of the seal wash housing and having a chamber extending from the first opening;

a seal assembly disposed in the gland of the seal wash housing and having a sealing surface abutting the sealing surface of the pump head in a surface region that encloses the first and second openings; and a wear-resistant coating disposed on the sealing surface of the pump head at least in the surface region where the sealing surface of the seal assembly abuts the sealing surface of the pump head.

2. The pump of claim 1 wherein the wear-resistant coating comprises a diamond like carbon (DLC) coating.

3. The pump of claim 1 wherein the wear-resistant coating comprises a titanium coating.

4. The pump of claim 1 wherein the pump head further comprises a first fluidic channel configured to supply a fluid from an inlet port to the chamber and a second fluid channel configured to pass a fluid from the second opening in the sealing surface of the pump head to an outlet port.

5. The pump of claim 1 further comprising a rod extending through the bore of the seal wash housing and into the chamber through the first opening in the sealing surface of the pump head.

6. The pump of claim 1 wherein the wear-resistant coating is disposed on an entirety of the sealing surface of the pump head.

7. The pump of claim 6 wherein the rod is a reciprocating plunger.

8. The pump of claim 1 wherein the surface region where the sealing surface of the seal assembly abuts the sealing surface of the pump head is an annular region.

* * * * *